US006941685B2

(12) United States Patent
Goy et al.

(10) Patent No.: US 6,941,685 B2
(45) Date of Patent: Sep. 13, 2005

(54) SNOWPLOW ASSEMBLY

(75) Inventors: Michael Goy, Waukesha, WI (US); Scott Kluck, Mequon, WI (US); Andre LeBlond, Owlshead, ME (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 0 days.

(21) Appl. No.: 10/282,630

(22) Filed: Oct. 29, 2002

(65) Prior Publication Data

US 2004/0079002 A1 Apr. 29, 2004

(51) Int. Cl.[7] ..... E01H 5/04

(52) U.S. Cl. ..... 37/232; 37/270; 172/816; 172/817

(58) Field of Search ..... 172/811, 816, 172/817; 37/231, 232, 233, 234, 235, 236, 264, 266, 270, 271

(56) References Cited

U.S. PATENT DOCUMENTS

| | | | | |
|---|---|---|---|---|
| 2,166,424 A | | 7/1939 | Coates | |
| 3,201,878 A | * | 8/1965 | Markwardt | 37/231 |
| 3,545,109 A | * | 12/1970 | Boschung | 37/233 |
| 3,587,751 A | * | 6/1971 | Schmidt | 172/264 |
| 3,626,614 A | | 12/1971 | Kahlbacher | |
| 3,650,054 A | | 3/1972 | Hanson | |
| 3,775,877 A | * | 12/1973 | Gove, Sr. | 37/233 |
| 4,307,523 A | | 12/1981 | Reissinger et al. | |
| 4,615,130 A | * | 10/1986 | Racicot | 37/231 |
| 4,907,358 A | | 3/1990 | Moore | |
| 5,088,215 A | * | 2/1992 | Ciula | 37/197 |
| 5,109,618 A | | 5/1992 | Grübler et al. | |
| 5,121,562 A | | 6/1992 | Feller | |
| 5,136,795 A | | 8/1992 | Rosenberg | |
| 5,353,530 A | * | 10/1994 | Pieper | 37/231 |
| 5,638,617 A | | 6/1997 | Bélanger et al. | |
| 5,697,172 A | | 12/1997 | Verseef | |
| 5,806,214 A | * | 9/1998 | Behrens et al. | 37/231 |
| 5,815,956 A | | 10/1998 | Lavin et al. | |
| 6,073,371 A | | 6/2000 | Goos et al. | |
| 6,125,559 A | * | 10/2000 | Mullenhour | 37/232 |
| 6,134,813 A | * | 10/2000 | Vickers | 37/196 |
| 6,219,943 B1 | | 4/2001 | Kitchell | |
| 6,269,556 B1 | | 8/2001 | Källqvist | |
| 6,564,479 B1 | * | 5/2003 | Vickers | 37/233 |
| 6,618,965 B1 | * | 9/2003 | Schultz et al. | 37/232 |

FOREIGN PATENT DOCUMENTS

| | | |
|---|---|---|
| DE | 1278465 | 9/1968 |
| DE | DT2552058 | 5/1977 |
| DE | 3108839 | 9/1982 |
| DE | 3325620 | 1/1985 |
| DE | 3542479 | 6/1987 |
| DE | 3937634 | 5/1991 |
| DE | 4202443 | 8/1993 |
| DE | 4204109 | 8/1993 |
| DE | 19854934 | 8/2000 |
| EP | 0580978 | 2/1994 |

* cited by examiner

*Primary Examiner*—Victor Batson
(74) *Attorney, Agent, or Firm*—Wood, Herron & Evans, LLP

(57) ABSTRACT

A snowplow assembly comprises a lift frame and A-frame operably pivotally connected together and an actuator operably connected between the lift frame and A-frame for effecting relative pivotal movement between the lift frame and A-frame. A plow blade includes a blade frame. The blade frame includes a tube of circular cross section which is operably pivotally connected to the A-frame. The tube is pivotally received by a quadrant, which is operably connected to the A-frame. A resilient element is operable between the blade frame and A-frame normally biasing a lower edge of the plow blade forwardly. The resilient element is an elastomeric loop. The pivotal connection of the plow blade to the A-frame in combination with the resilient element provides a trip function of the plow blade. The plow blade is a composite. The circular tube of the blade frame provides torsional stiffness to the composite blade.

11 Claims, 5 Drawing Sheets

SNOWPLOW ASSEMBLY

FIELD OF THE INVENTION

This invention relates to snow removal equipment and, more particularly, to a snowplow assembly of lightweight construction.

BACKGROUND OF THE INVENTION

Passenger vehicles have been used for sometime as a means for plowing snow by utilizing snowplow assemblies which are detachably mounted to the passenger vehicle. The passenger vehicles of choice for such plowing have included full size pickups and sport utility vehicles ("SUV's".)

Efforts are underway to utilize smaller passenger vehicles for plowing snow. For example, it is desirable to be able to utilize a lightweight pickup as the vehicle for plowing snow with the detachably mountable snowplow assembly. However, conventional detachable snowplow assemblies, built for full size pickups and/or SUV's, can subject such a lightweight pickup to excessive loads due to the weight of the snowplow assembly.

Accordingly, it is desirable to redesign the conventional passenger vehicle mountable snowplow assembly in an effort to reduce its weight for use on lighter weight vehicles, for example lightweight pickups.

SUMMARY OF THE INVENTION

In accordance with the principles of the present invention, a snowplow assembly comprises a lift frame and A-frame operably pivotally connected together, an actuator operably connected between the lift frame and A-frame for effecting relative pivotal movement between the lift frame and A-frame and a plow blade including a blade frame, the blade frame including a tube of circular cross section, the tube operably pivotally connected to the A-frame.

The lift frame and A-frame can be adapted to be connected to a vehicle mount frame as a unit. The tube of the blade frame can be pivotally received by a quadrant, the quadrant operably connected to the A-frame. The snowplow assembly can further include a resilient element operable between the blade frame and A-frame normally biasing a lower edge of the plow blade forwardly; the pivotal connection of the plow blade to the A-frame in combination with the resilient element provides a trip function of the plow blade. The resilient element can be non-metallic, for elastomeric. The plow blade can also be non-metallic, for example a composite. The tube can extend substantially the width of the plow blade. The lift frame can include a pair of extensions extending away from the plow blade, and can be adapted to be received by a vehicle mount frame. The snowplow assembly can further include a pair of support stands removably secured to the lift frame. The tube can include a pair of stops which cooperate with a pair of urethane cushions on the quadrant to limit pivoting movement of the plow blade.

In another aspect, a snowplow assembly comprises a lift frame and an A-frame operably pivotally connected together, an actuator operably connected between the lift frame and A-frame for effecting relative pivotal movement between the lift frame and the A-frame, a plow blade operably pivotally connected to the A-frame, and a non-metallic resilient endless loop operably connected between the plow blade and A-frame; the pivotal connection of the plow blade to the A-frame in combination with the resilient loop provides a trip function of the plow blade.

In yet another aspect, a snowplow assembly comprises an A-frame and a plow blade including a tube of circular cross section, the tube operably pivotally connected to the A-frame.

In still another aspect, a snowplow assembly comprises an A-frame, a plow blade operably pivotally connected to the A-frame, and a nonmetallic resilient endless loop operably connected between the plow blade and the A-frame; the pivotal connection of the plow blade to the A-frame in combination with the resilient loop provides a trip function of the plow blade.

In a further aspect, a snowplow assembly comprises an A-frame, a plow blade including a tube of circular cross section, the tube operably pivotally connected to the A-frame, and a non-metallic resilient endless loop operably connected between the plow blade and A-frame; the pivotal connection of the plow blade to the A-frame in combination with the resilient loop provides a trip function of the plow blade.

These and other advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
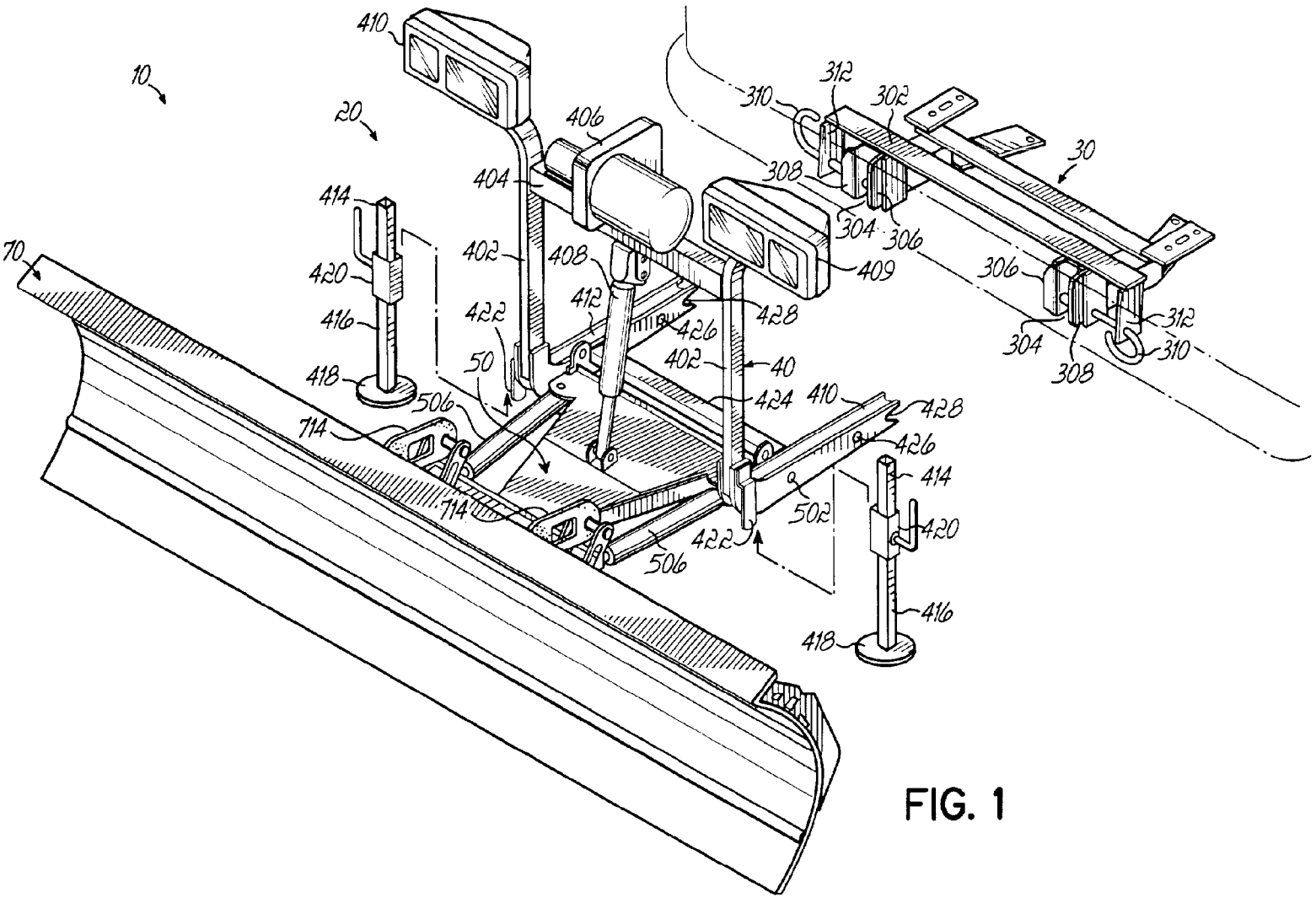
FIG. 1 is a perspective view of a snowplow assembly according to the principles of the present invention.

Referring first to FIG. 1, there is illustrated a snowplow and mount assembly 10 according to the principles of the present invention. The assembly 10 includes a snowplow assembly 20 and a vehicle mount assembly 30.

Figure 2A:
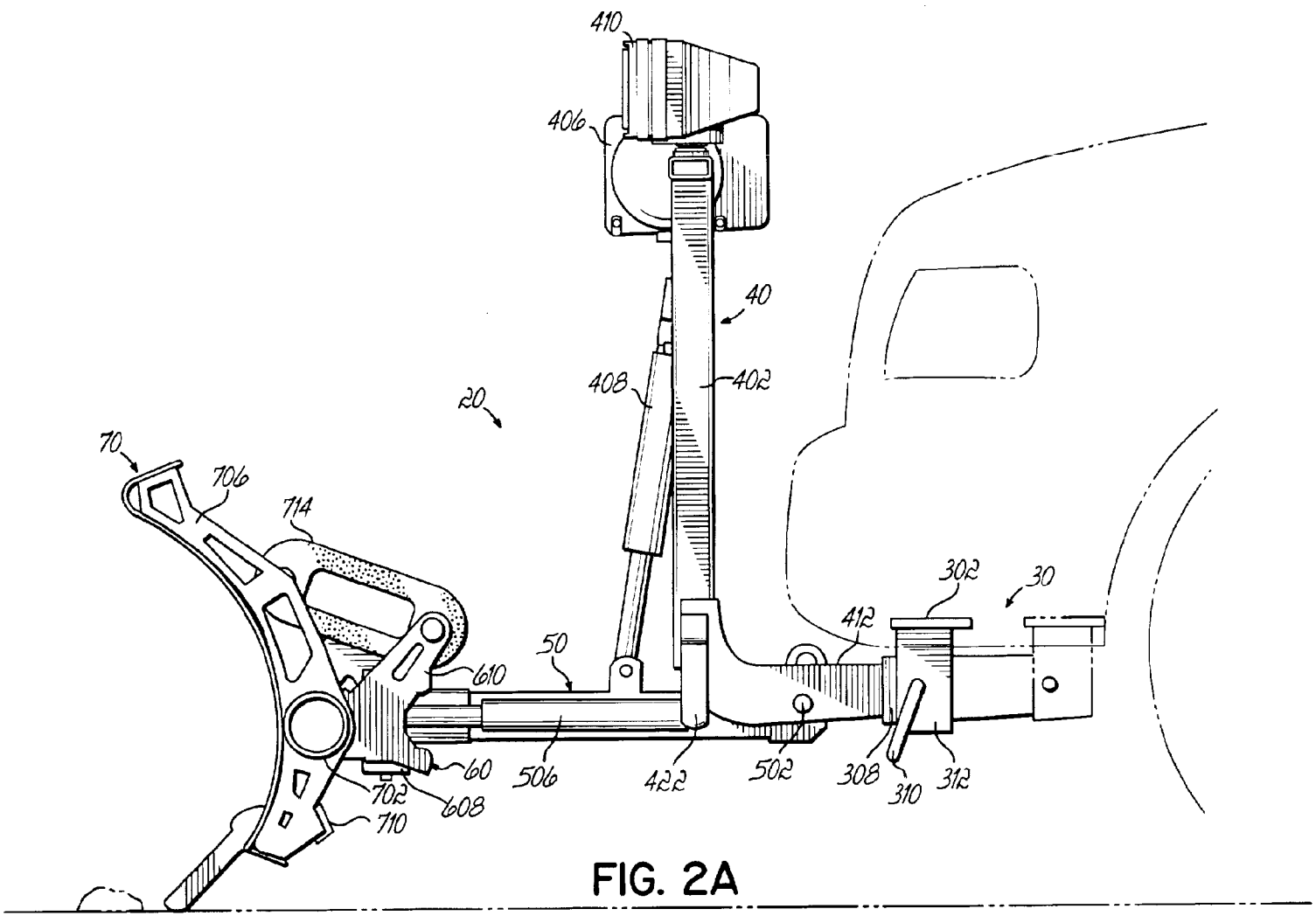
FIG. 2A is a side view of the snowplow assembly of FIG. 1 prior to striking an obstruction.
Figure 2B:
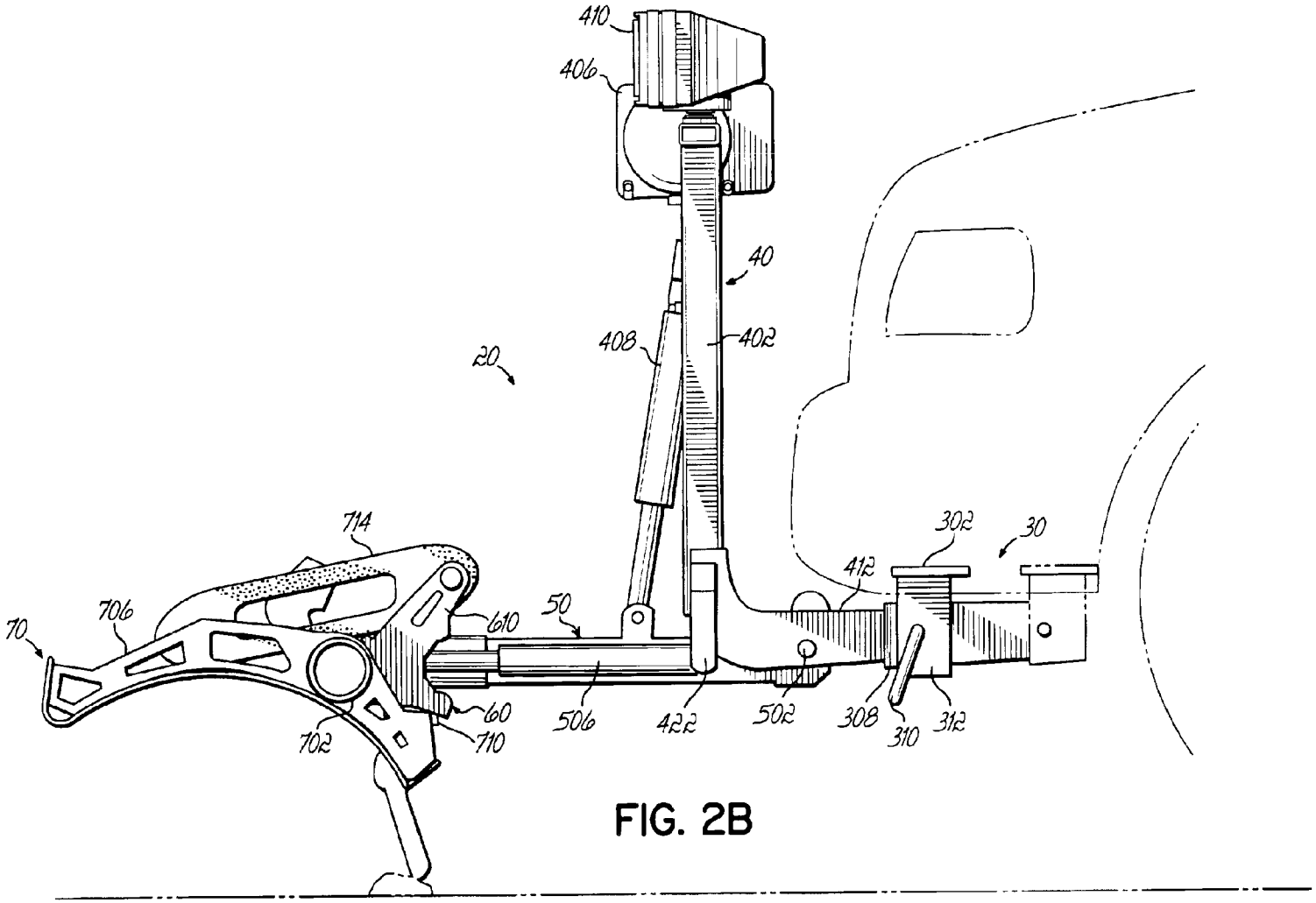
FIG. 2B is a view similar to FIG. 2A but showing the trip function of the snowplow assembly caused by the blade striking an obstruction.
Figure 3:
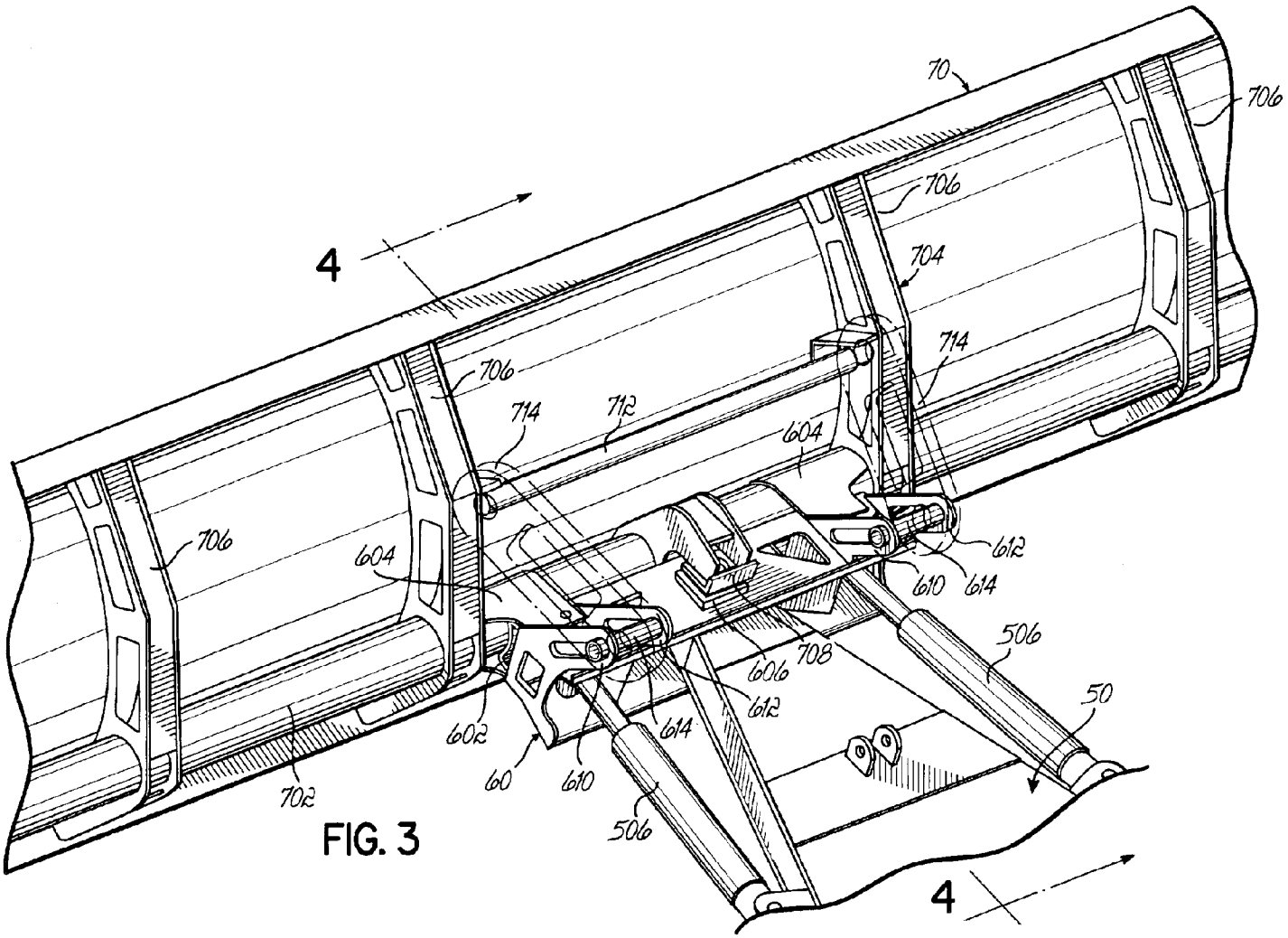
FIG. 3 is a rear perspective view of the snowplow assembly.
Figure 4:
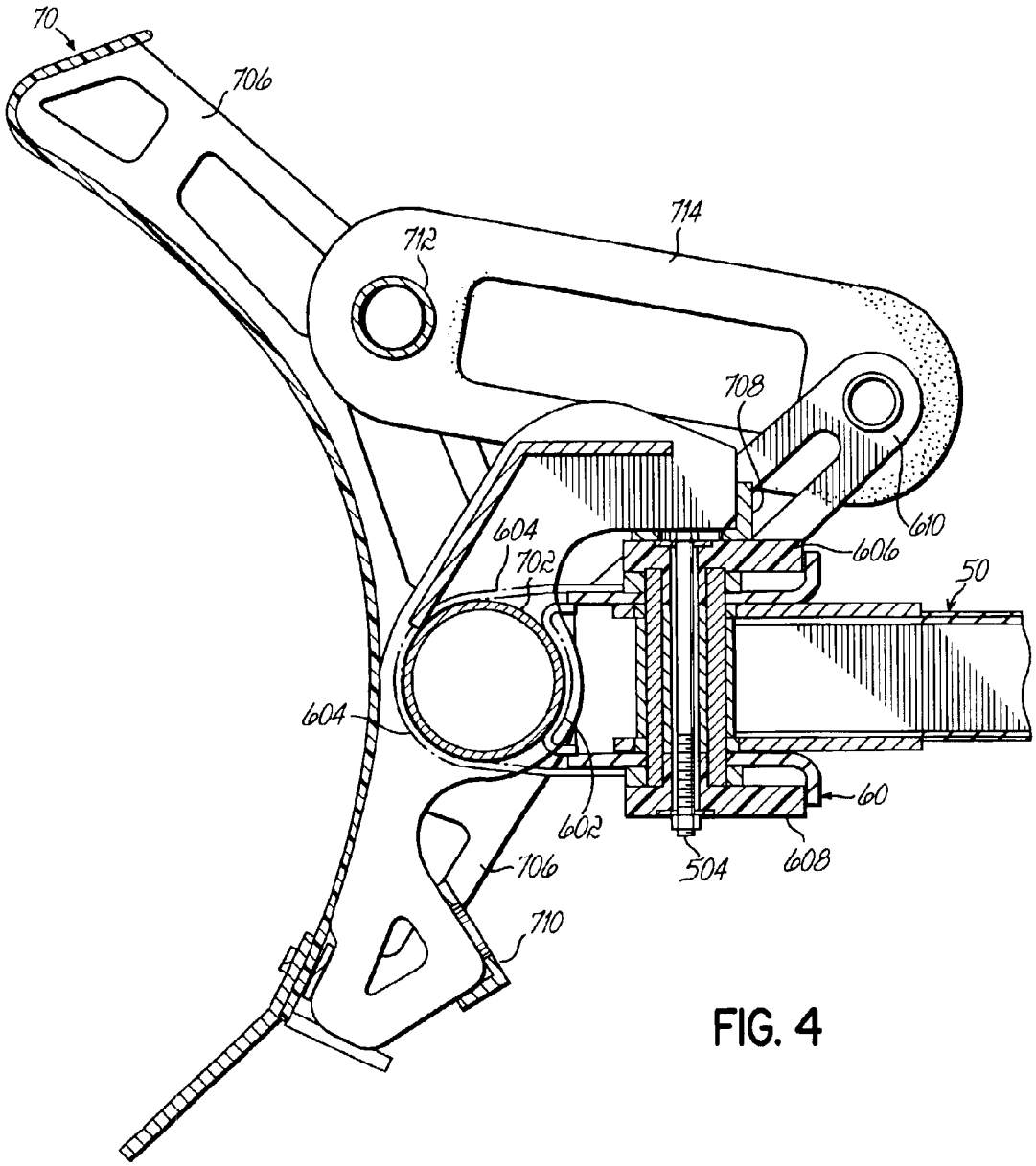
FIG. 4 is a cross-sectional view taken along line 4—4 of FIG. 3.

Referring to FIGS. 1–3, snowplow assembly 20 can include a lift frame 40, an A-frame 50, a quadrant 60 and a plow blade 70. Lift frame 40 can include a pair of upwardly extending supports 402 interconnected by an upper laterally extending support 404. Lateral extending support 404 can support a hydraulic motor 406 to supply hydraulic fluid to a hydraulic lift cylinder 408, also supported by support 404 and connected to A-frame 50. A pair of headlamps 410 can be supported by the upwardly extending supports 402. Lift assembly 40 can further include a pair of rearwardly extending arms 412 which are adapted to be removably secured to mount frame assembly 30, as will be described below. Lift assembly 40 can further include a pair of support stands 414 each of which includes a leg 416, foot 418 and height adjustment mechanism 420. Each of the stands 414 can be removably secured to the lift frame 40 by slipping mechanism 420 onto tongue 422 which can be secured to vertical member 402. A lower laterally extending support 424 can interconnect arms 412.

A-frame 50 has a rear end which can be pivotally connected to arms 412 of lift assembly 40 via pivot pins or bolts 502, and has a forward end which can be pivotally connected to the quadrant 60 via pivot bolt 504. Pivot pins 502 permit pivoting of the A-frame 50, quadrant 60 and blade 70 about a generally horizontal, transverse axis, whereas pivot bolt 504 permits quadrant 60 and blade 70 to be pivot relative to A-frame 50 about a generally vertical axis. A-frame 50 can further include a pair of hydraulic cylinders 506 operably connected between the A-frame 50 and quadrant 60 for pivoting the quadrant 60 and blade 70 about the generally vertical axis which is defined by pivot bolt 504.

Quadrant 60 can include a first semi-circular structure 602 and a second semi-circular structure 604 which journal or pivotally support a circular cross section tube 702 on the rear side of blade 70. Tube 702 can be formed as part of a framework 704 to which blade 70 is mounted, can be continuous and have a length extending substantially the width of the blade 70, can be about 2–2.75 inches in outer diameter and can be spaced away from the blade 70 about 0.75 inch. Framework 704 can include ribs 706 having lightening cuts therethrough to reduce the weight thereof, as well as holes therethrough through which to install tube 702. Tube 702 and ribs 706 can be carbon steel; tube 702 can be secured to ribs 706 as by welding. Blade 70 can be attached to framework 704 with suitable fasteners (not shown). A pair of stops 708 and 710 can be fixedly secured to tube 702. Stops 708 and 710 limit the angle of pivoting of blade 70 during the trip function (FIGS. 2A and 2B.) Stops 708 and 710 can cooperate with urethane cushions 606 and 608, mounted to quadrant 60 with pivot bolt 504, to limit pivoting of blade 704. Blade 70 can be of lightweight composite construction.

Quadrant 60 can include a pair of arms 610, 612 on each lateral side thereof, each pair supporting a bar 614. Blade assembly 70 can include a cross bar 712 in between two of the ribs 706 of the blade frame 704. A pair of resilient endless elastomeric loops or bands 714 can be installed to bar 712 and to bars 614 to provide a restoring force to restore blade 70 to the position shown in FIG. 2A after being tripped by an obstacle, as shown in FIG. 2B.

Referring back to FIG. 1, vehicle mount assembly 30 includes a mount frame 302 adapted to be secured to a vehicle (phantom) having a pair of sockets 304 each formed by inboard 306 and outboard 308 plates. Sockets 304 accept arms 412 of lift frame 40. The lift frame 40, A-frame 50, quadrant 60 and plow blade 70 are connectable to the mount frame 302 as a unit. Arms 412 are inserted into sockets 304. Notches 428 in the ends of arms 412 each receive a pin (not shown) fixed within each socket 304. Removable pins 310 can then pass through holes in alignment plate 312 and through holes in both socket 304 forming plates 306, 308, as well as through holes 426 in arms 412 securing lift frame 40 and hence A-frame 50, quadrant 60 and plow blade 70 to mount frame 302.

The lightweight nature of elastomeric bands 714, as compared to metallic tension or compression springs, along with the composite construction of blade 70, aid in reducing the weight of the snowplow assembly 20. Further, while providing a trip function of the blade 70, tube 702 also provides torsional stiffness for composite blade 70.

If desired, tube 702 can be employed to torsionally stiffen blade 70 without providing a trip function for blade 70. In that case, tube 702 need not be circular in cross-section; most any hollow, closed cross-section tube such as those having square, rectangular, etc. cross-sections would suffice. For that matter, the cross-section need not be constant the length of the tube 702.

Those skilled in the art will readily recognize numerous adaptations and modifications which can be made to the present invention which will result in an improved snowplow assembly, yet all of which will fall within the spirit and scope of the present invention as defined in the following claims. Accordingly, the invention is to be limited only by the scope of the following claims and their equivalents.

We claim:

1. A snowplow assembly comprising:

an A-frame;

a plow blade operably pivotally connected to said A-frame; and a nonmetallic resilient endless loop operably connected between said plow blade; and the pivotal connection of said plow blade to said A-frame in combination with said resilient loop providing a trip function of said plow blade;

wherein said plow blade includes a blade frame, said blade frame including a tube of circular cross-section said tube operably pivotally connected to said A-frame.

2. The snowplow assembly of claim 1 wherein said tube of said blade frame is pivotally received by a quadrant, said quadrant operably connected to said A-frame.

3. The snowplow assembly of claim 2 wherein said tube includes a pair of stops which cooperate with a pair of urethane cushions on said quadrant to limit pivoting movement of said plow blade.

4. The snowplow assembly of claim 1 wherein said tube extends substantially the width of said plow blade.

5. A snowplow assembly comprising:

a lift frame and an A-frame operably pivotally connected together;

an actuator operably connected between said lift frame and A-frame for effecting relative pivotal movement between said lift frame and A-frame;

a plow blade operably pivotally connected to said A-frame; and a nonmetallic resilient endless loop operably connected between said plow blade and A-frame in such a manner as to function as an extension spring member when said blade encounters an obstacle during forward movement;

the pivotal connection of said plow blade to said A-frame in combination with said resilient loop providing a trip function of said plow blade; and wherein said plow blade includes a blade frame, said blade frame including a tube of circular cross-section, said tube operably pivotally connected to said A-frame.

6. The snowplow assembly of claim 5 wherein said tube of said blade frame is pivotally received by a quadrant, said quadrant operably connected to said A-frame.

7. A snowplow assembly comprising:

a lift frame and an A-frame operably pivotally connected together;

an actuator operably connected between said lift frame and A-frame for effecting relative pivotal movement between said lift frame and A-frame;

a plow blade operably pivotally connected to said A-frame; and a nonmetallic resilient endless loop operably connected between said plow blade and A-frame;

the pivotal connection of said plow blade to said A-frame in combination with said resilient loop providing a trip function of said plow blade;

wherein said plow blade includes a blade frame, said blade frame including a tube of circular cross-section, said tube operably pivotally connected to said A-frame;

wherein said tube extends substantially the width of said plow blade.

8. A snowplow assembly comprising:

a lift frame and an A-frame operably pivotally connected together;

an actuator operably connected between said lift frame and A-frame for effecting relative pivotal movement between said lift frame and A-frame;

a plow blade operably pivotally connected to said A-frame; and a nonmetallic resilient endless loop operably connected between said plow blade and A-frame;

the pivotal connection of said plow blade to said A-frame in combination with said resilient loop providing a trip function of said plow blade;

wherein said plow blade includes a blade frame, said blade frame including a tube of circular cross-section, said tube operably pivotally connected to said A-frame;

wherein said tube of said blade frame is pivotally received by a quadrant, said quadrant operably connected to said A-frame;

wherein said tube includes a pair of stops which cooperate with a pair of urethane cushions on said quadrant to limit pivoting movement of said plow blade.

9. A snowplow assembly comprising:

an A-frame; and a plow blade including a tube of circular cross-section, said tube operably pivotally connected to said A-frame;

wherein said tube of said blade is pivotally received by a quadrant, said quadrant operably connected to said A-frame;

wherein said tube includes a pair of stops which cooperate with a pair of urethane cushions on said quadrant to limit pivoting movement of said plow blade.

10. A snowplow assembly comprising:

an A-frame;

a plow blade including a tube of circular cross-section, said tube operably pivotally connected to said A-frame; and a nonmetallic resilient endless loop operably connected between said plow blade and A-frame;

the pivotal connection of said plow blade to said A-frame in combination with said resilient loop providing a hip function of said plow blade;

wherein said tube extends substantially the width of said plow blade.

11. A snowplow assembly comprising:

an A-frame;

a glow blade including a tube of circular cross-section, said tube operably pivotally connected to said A-frame; and a nonmetallic resilient endless loop operably connected between said plow blade and A-frame in such a manner as to function as a tension spring member when said blade encounters an obstacle during forward movement;

the pivotal connection of said plow blade to said A-frame in combination with said resilient loop providing a trip function of said plow blade;

wherein said tube of said blade is pivotally received by a quadrant, said quadrant operably connected to said A-frame; and wherein said tube includes a pair of stops which cooperate with a pair of urethane cushions on said quadrant to limit pivoting movement of said plow blade.

* * * * *

UNITED STATES PATENT AND TRADEMARK OFFICE

CERTIFICATE OF CORRECTION

PATENT NO. : 6,941,685 B2
APPLICATION NO. : 10/282630
DATED : September 13, 2005
INVENTOR(S) : Michael Goy, Scott Kluck and Andre LeBlond It is certified that error appears in the above-identified patent and that said Letters Patent is hereby corrected as shown below:

Column 4, Line 19, Claim 1 reads: "blade frame including a tube of circular cross-section"; it should read: -- blade frame including a tube of circular cross-section, --.

Column 6, Line 12, Claim 10 reads: "in combination with said resilient loop providing a hip"; it should read: -- in combination with said resilient loop providing a trip --.

Column 6, Line 18, Claim 11 reads: "a glow blade including a tube of circular cross-section,"; it should read: -- a plow blade including a tube of circular cross-section, --.

Signed and Sealed this

Seventeenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 6,941,685 B2
APPLICATION NO. : 10/282630
DATED : September 13, 2005
INVENTOR(S) : Michael Goy, Scott Kluck and Andre LeBlond It is certified that error appears in the above-identified patent and that said Letters Patent is hereby corrected as shown below:

Column 4, line 14, Claim 1 reads: "between said plow blade; and"; it should read: -- between said plow blade and A-frame; --

Signed and Sealed this
Twenty-second Day of November, 2011

David J. Kappos

David J. Kappos
*Director of the United States Patent and Trademark Office*